US006106305A

United States Patent [19]

Kozel et al.

[11] Patent Number: 6,106,305

[45] **Date of Patent: *Aug. 22, 2000**

[54] ELASTOMERIC CONNECTOR HAVING A PLURALITY OF FINE PITCHED CONTACTS, A METHOD FOR CONNECTING COMPONENTS USING THE SAME AND A METHOD FOR MANUFACTURING SUCH A CONNECTOR

[75] Inventors: Charles A. Kozel, McHenry; James M. Kudla, Mount Prospect; Mark Stack, Hoffman Estates, all of Ill.

[73] Assignee: Methode Electronics, Inc., Chicago, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/833,746

[22] Filed: Apr. 11, 1997

Related U.S. Application Data

[63] Continuation-in-part of application No. 08/796,256, Feb. 6, 1997, Pat. No. 5,904,580.

[51] Int. Cl.[7] ..... H01R 12/00

[52] U.S. Cl. ..... 439/66; 439/91

[58] Field of Search ..... 439/66, 91, 387, 439/886, 590

[56] References Cited

U.S. PATENT DOCUMENTS

| | | | |
|---|---|---|---|
| 3,934,959 | 1/1976 | Gilissen et al. | 439/66 |
| 3,954,317 | 5/1976 | Gilissen et al. | 439/66 |
| 4,161,346 | 7/1979 | Cherian et al. | 439/591 |
| 4,199,209 | 4/1980 | Cherian et al. | 439/591 |
| 4,793,814 | 12/1988 | Zifcak et al. | 439/66 |
| 5,230,632 | 7/1993 | Baumberger et al. | 439/74 |
| 5,427,535 | 6/1995 | Sinclair | 439/66 |

FOREIGN PATENT DOCUMENTS

| | | |
|---|---|---|
| 1-157075 | 6/1989 | Japan . |

*Primary Examiner*—Renee Luebke
*Assistant Examiner*—T. C. Patel
*Attorney, Agent, or Firm*—David L. Newman

[57] ABSTRACT

An elastomeric connector having fine pitched contacts is provided in addition to a method for connecting components using such a connector and a method of manufacturing the same. The connector includes a body formed from an elastomeric material with contacts arranged to extend through the body and exposed at each side of the body. The contacts are bent to form a contact surface that is oriented at an angle with respect to the sides of the body. The contacts may include a radiused section that is formed in the elastomeric material. Grooves may be formed in the body of the connector separating adjacent contacts and providing additional flexibility of the connector. The contacts may provide for a wiping action of between 0.003 and 0.015 inches and the connector may provide for a spring force of greater than between 15 and 90 grams per contact after 10,000 cycles.

23 Claims, 6 Drawing Sheets

ELASTOMERIC CONNECTOR HAVING A PLURALITY OF FINE PITCHED CONTACTS, A METHOD FOR CONNECTING COMPONENTS USING THE SAME AND A METHOD FOR MANUFACTURING SUCH A CONNECTOR

This application is a continuation-in-part of application U.S. Ser. No. 08/796,256 , filed Feb. 6, 1997 and U.S. Pat. No. 5,904,580 entitled "AN ELASTOMERIC CONNECTOR HAVING A PLURALITY OF FINE PITCHED CONTACTS, A METHOD FOR CONNECTING COMPONENTS USING THE SAME AND A METHOD FOR MANUFACTURING SUCH A CONNECTOR".

BACKGROUND OF THE INVENTION

The present invention generally relates to a connector, particularly a high density connector. More specifically, the present invention relates to an elastomeric connector particularly suitable for interconnection between a device and a printed circuit board or between two or more printed circuit boards requiring fine pitch interconnection. The present invention further relates to a method for connecting two components and a method for manufacturing such a connector.

It is, of course, generally known to provide connectors for providing interconnection between components, such as printed circuit boards and other devices that require the interconnection under conditions of high density, fine pitch, as well as requiring high performance.

An important consideration in the manufacture and design of elastomeric connectors is the contact force applied by the connectors which affects the performance and reliability of the same. This is particularly relevant for connectors that are repeatedly mated and unmated with the devices or printed circuit boards in which they are associated. In addition, taking this factor into consideration, current elastomeric connectors are costly to manufacture and nonetheless often encounter problems such as permanent deformation of the contact or contacts.

In addition, most known elastomeric connectors do not provide "wiping action" to break down oxidation layers produced through use of the connector. Without the wiping action, oxidation layers or buildup is often formed on the contact causing the connector to become unreliable in its performance. Wiping action serves to clean the metallic contacts during insertion and assists in maintaining clean surfaces at the interface during operation of the device in which the connector is implemented. Wiping action is particularly important for separable connectors that require repetitive mating and unmating and also in environments where dust can be a factor.

A need, therefore, exists for an improved elastomeric connector that overcomes the deficiencies of known elastomeric connectors and improves the reliability and performance of the contact even through repeated usage of the same. In addition, a method for connecting components using such a connection as well as a method for manufacturing such a connector are also needed.

SUMMARY OF THE INVENTION

The present invention relates to a high density elastomeric connector with contacts that absorb the force applied to the connector. In addition, the present invention provides an elastomeric connector with electrical contacts molded into an elastomeric that provide wiping action. A method for connecting components and a method for manufacturing such a connector are also provided.

In an embodiment of the present invention, a connector is provided. The connector has a body formed from an elastomeric material having a first side and a second side. A plurality of contacts is arranged uniformly in the body such that each contact integrally extends from the first side to the second side of the body wherein ends of each of the plurality of contacts are exposed at each of the first side and the second side.

In an embodiment, the contacts are bent at a point near each of the ends to form a contact surface such that the contact surfaces are oriented at an angle with respect to the sides of the body.

In an embodiment, each of the plurality of contacts is substantially parallel to one another.

In an embodiment, a portion of each of the contacts in the elastomeric material of the body includes a radiused section. The radiused section is substantially at a point halfway between the first side and the second side.

In an embodiment, the angle between the contact surfaces and the sides of the body is acute.

In an embodiment, the contact surfaces include a particle formed thereon. The particle is made from diamonds.

In an embodiment, a lip is integrally formed with each of the contact surfaces and each is formed at an angle with respect to the contact surface.

In an embodiment, third and fourth sides are perpendicular to the first and second sides of the body wherein the first, second, third and fourth sides define the body. Grooves may be formed in the third and fourth sides of the body wherein the grooves separate adjacent contacts extending through the body.

In an embodiment, the elastomeric material is silicone.

In another embodiment of the present invention, a method is provided for connecting two components. The method comprises the steps of: providing a connector wherein the connector has a body formed from an elastomeric material, the body having a first side and a second side; providing a plurality of contacts arranged uniformly and extending between the first side and the second side of the body of the connector wherein each of the plurality of contacts has a contact surface that is exposed at the first side and the second side of the body; and connecting components to the connector thereby providing an electrical connection between the components via the connector.

In an embodiment, particles are provided on the contact surfaces of the contacts.

In an embodiment, grooves are formed in the body of the connector.

In an embodiment, the contact surfaces are compressed during connection of the components.

In an embodiment, each of the, plurality of contacts includes a non-linear section formed in the body of the connector.

In another embodiment of the present invention, a method for manufacturing a connector is provided. The method comprises the steps of: providing a plurality of contacts in chain form or with carriers; molding elastomeric material forming a body around a portion of the contacts wherein the contacts are substantially spaced and parallel to one another; and removing a carrier member at ends of each of the plurality of contacts such that only a finite portion forming a contact surface is exposed adjacent the body.

In an embodiment, a radiused section is provided in each of the plurality of contacts before molding such that the radiused section is within the body after molding.

In an embodiment, particles are provided on the contact surfaces.

In an embodiment, grooves are formed in exterior walls of the body.

In an embodiment the contacts are formed so that when the elastomeric connector is compressed by mating of the elastomeric connector with a socket connector having contact pads the contacts of the elastomeric connector will provide a wiping action on the pads of the mating connector. In an embodiment the elastomeric connector will provide a wiping stroke between 0.005 inches and 0.015 inches. In a preferred embodiment the contacts the elastomeric connector will provide for a spring force of approximately between 15 and 90 grams per contact. In a preferred embodiment the contacts have sufficient spring force to penetrate an oxidation layer of a contact pad to which the contact is mated.

It is, therefore, an advantage of the present invention to provide an elastomeric connector, a method of manufacturing such a connector, as well as a method of connecting components having a contact or a plurality of contacts that absorbs the majority of the force applied to the connector.

Another advantage of the present invention is to provide an elastomeric connector, a method of manufacturing such a connector, as well as a method of connecting components that implements electrical contacts molded into an elastomer.

Yet another advantage of the present invention is to provide an elastomeric connector, a method of manufacturing such a connector, as well as a method of connecting components with contacts that provide a wiping action particularly suitable for removing buildup on the contact from oxidation.

And, another advantage of the present invention is to provide an elastomeric connector, a method of manufacturing such a connector, as well as a method of connecting components that implements contacts that are resilient and are resistant to permanent deformation.

Moreover, an advantage of the present invention is to provide an elastomeric connector, a method of manufacturing such a connector, as well as a method of connecting components wherein the connector is manufactured via injection molding and/or progressive stamping.

A still further advantage of the present invention is to provide an elastomeric connector, a method of manufacturing such a connector, as well as a method of connecting components that is inexpensive.

Yet another advantage of the present invention is to provide an elastomeric connector, a method of manufacturing such a connector, as well as a method of connecting components wherein the connector can be manufactured in various shapes to meet specific requirements.

And, another advantage of the present invention is to provide an elastomeric connector, a method of manufacturing such a connector, as well as a method of connecting components that has contacts with high density and a fine pitch that also operates in a reliable manner and with high electrical and mechanical performance.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to an elastomeric connector having contacts that are preferably insert molded into an elastomeric material, such as silicone. The elastomeric connector allows interconnection between, for example, a device and a printed circuit board or between two printed circuit boards requiring high density and fine pitch interconnection. The present invention further provides a method of connecting components using an elastomeric connector as well as a method of manufacturing such a connector.

Figure 1:
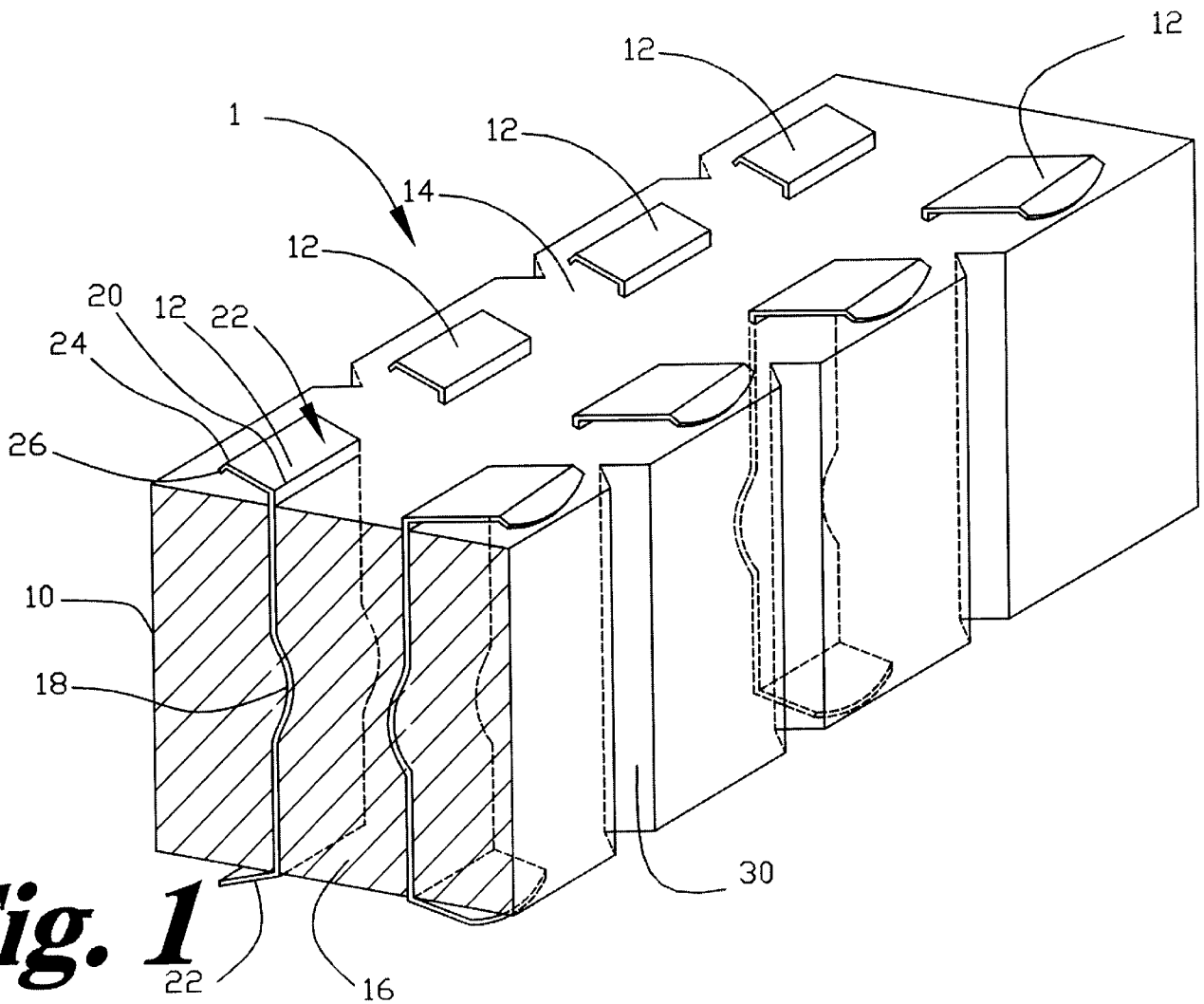
FIG. 1 illustrates a perspective view of an embodiment of an elastomeric connector of the present invention.

Referring now to the drawings wherein like numerals refer to like parts, FIG. 1 illustrates an embodiment of a connector 1 of the present invention. The connector 1 is formed from a body 10 and a plurality of contacts 12 extending from an exterior side 14 at one end of the body 10 through a width of the body 10 to an opposite exterior side 16 of the body 10. Preferably, the body 10 is constructed from an elastomeric material, such as silicone. As a result, the body 10 is flexible and capable of manipulation into various shapes and positions and provides a resiliency in order to help provide a spring force.

Figure 4:
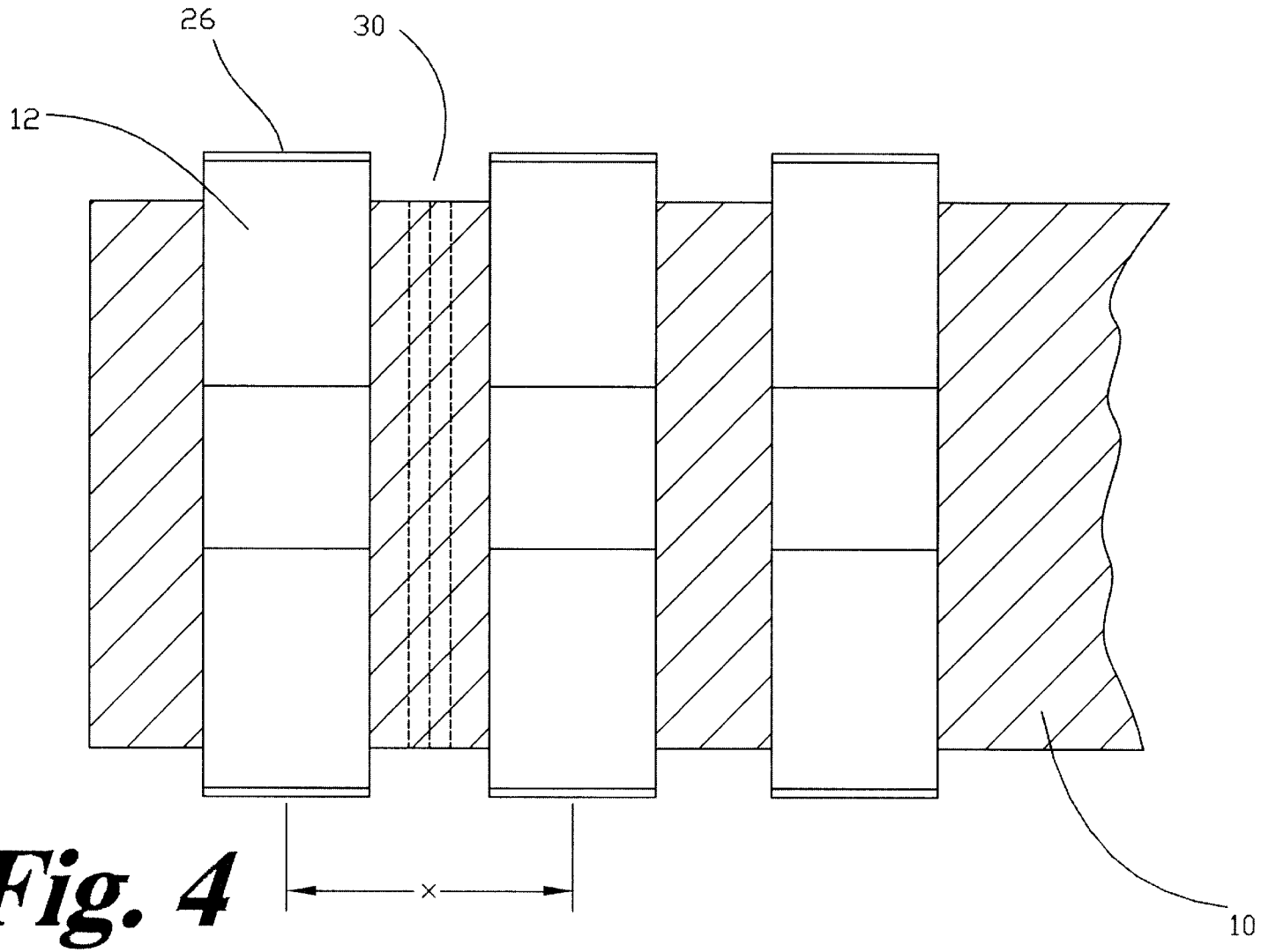
FIG. 4 illustrates a side view of an embodiment of an elastomeric connector of the present invention.

The contacts 12 of the present invention are preferably constructed from beryllium copper and have a thickness of approximately 0.003 inches. The contact may be plated with gold or plated with gold and nickel. Spacing between adjacent ones of the contacts 12 generally designated at X in FIG. 4 is approximately 0.019 inches or half millimeter or greater. To manufacture the connector 1, the contacts 12 may be provided on a carrier (not shown) that connects adjacent contacts. Preferably, the carrier uniformly connects the contacts integrally with the carrier.

As illustrated in FIG. 1, the portion of the contact 12 within the body 10 of the connector 1 is substantially linear between the exterior sides 14,16 except for a radiused section 18 formed substantially at a midpoint between the exterior sides 14, 16 of the body 10.

As further illustrated in FIG. 1, the contact 12 is exposed at the exterior sides 14,16 exterior to the body 10 of the connector 1. In an embodiment, exterior to the body 10, the contact 12 is bent at an edge 20 forming a contact surface 22 which, in turn, preferably forms an acute angle between the contact surface 22 and the exterior sides 14,16 of the body 10. At an edge 24 of the contact 12, a lip 26 is formed by bending the contact 12 as illustrated. The lip 26 helps to provide a defined point of electrical contact apart from the rough edge where the contact was sheared and separated from the carrier. As a result, symmetrical contact surfaces 22 are formed on each of the exterior sides 16,18 of the body 10 of the connector 1. The contact surfaces 22 provide connections between, for example, two printed circuit boards located on each side of the connector 1 or a printed circuit board and another device, as another example.

Figure 2:
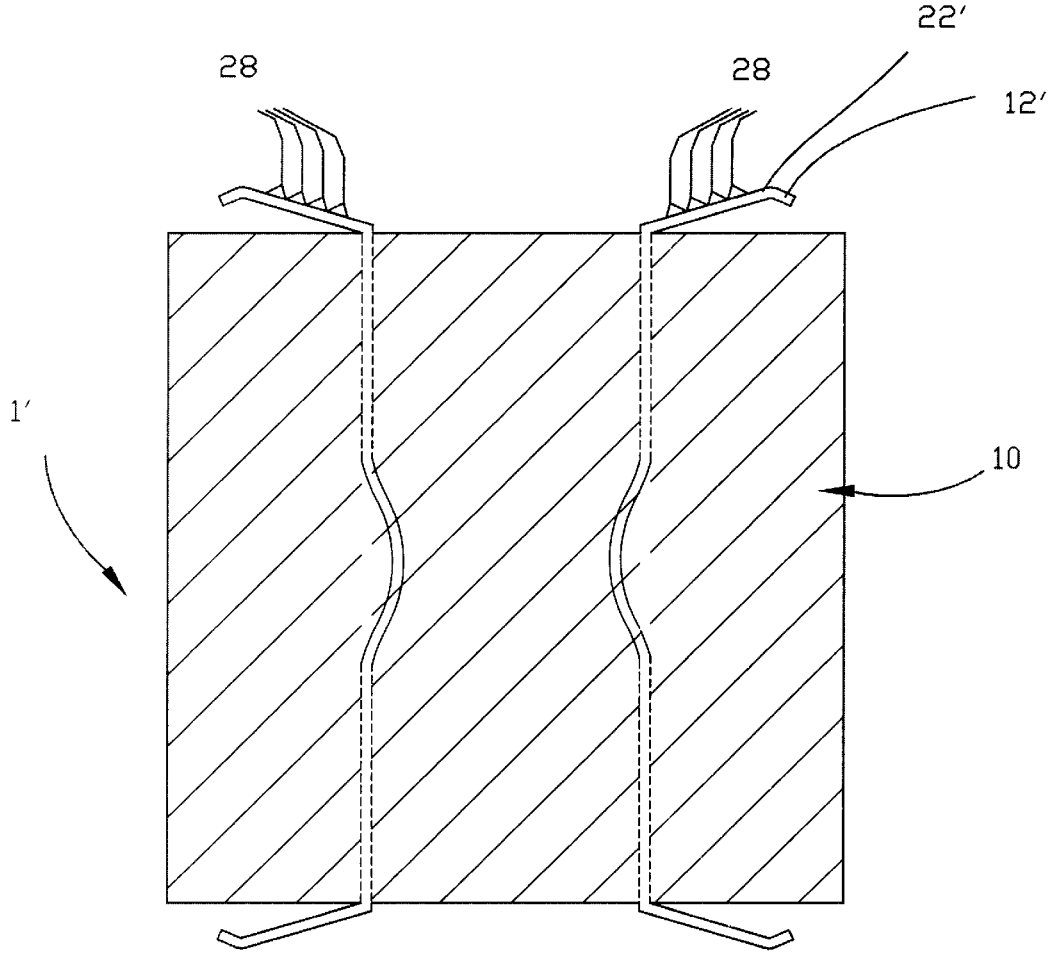
FIG. 2 illustrates a cross-sectional view of an embodiment of an elastomeric connector of the present invention incorporating particles on a surface of the contact.

Referring now to FIG. 2, a cross-sectional view of another embodiment of a connector 1' of the present invention is illustrated. The connector 1' includes a body 10 and a plurality of contacts 12'. Formed on the plurality of contacts 12' are particles 28, such as diamond particles plated on a contact surface 22' of the contact 12'. Although illustrated on only one side of the body 10 of the connector 1', the particles 28 may also be plated to the contact surfaces 22' on the opposite side of the body 10. The particles 28 assist in breaking down oxidation layers formed through oxidation on the contact surfaces 22'.

Figure 3:
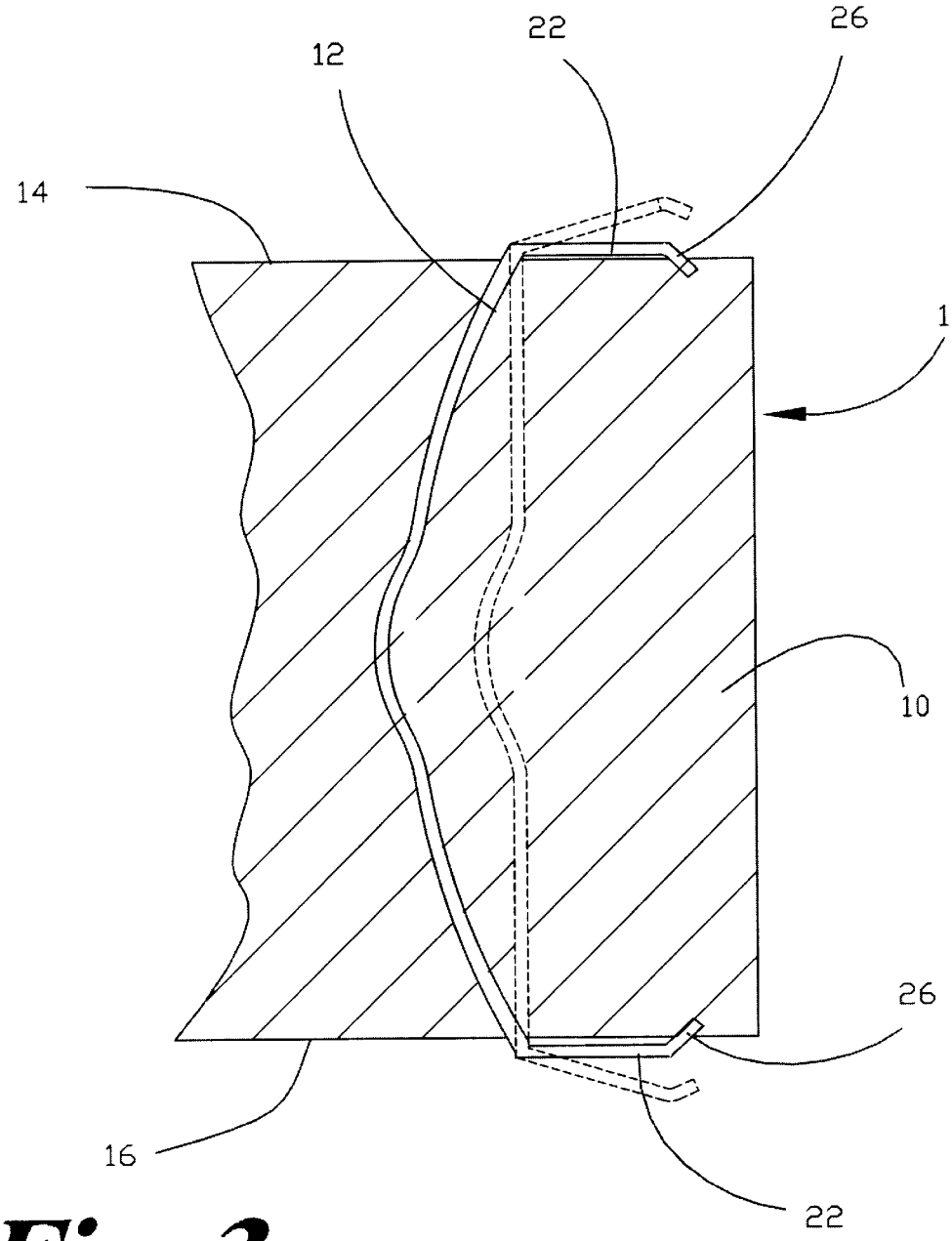
FIG. 3 illustrates a cross-sectional view of an embodiment of an elastomeric connector of the present invention with force applied to the contact of the connector.

FIG. 3 illustrates a cross-sectional view of the connector 1 in a position between, for example, two printed circuit boards (not shown) or a device and a printed circuit board, for example, i.e. during use of the connector 1. As shown, the contact surfaces 22 of the connector 1 are compressed such that the lip 26 of the contact 12 engages or otherwise contacts the exterior sides 14,16 of the body 10 of the connector 1. In turn, the contact 12 may also flex internally within the body 10 of the connector 1 as illustrated. That is, the elastomeric material of the body 10 allows for the flexure of the contact 12 within the interior of the body 10 due to the compression of the contact surfaces 22 of the contacts 12. Although the contact surfaces 22 are shown engaged or contacting the body 10, it should be understood that any degree of compression of the contact surface 22 of the contact 12 may result from implementation of the connector 1 in a system requiring a connection. In a preferred embodiment, once the contact surface 22 abuts against the exterior sides 14,16 of the elastomer body 10, the two members, e.g. the contact surface 22 and the elastomer body 10, compress simultaneously to provide the desired contact force. The contacts 12 and elastomeric body 10 combine to provide a predetermined spring force or compression distance dependent on the thickness and volume and composition of the elastomeric body 10 and the shape, weight and composition of the contacts 12. In a preferred embodiment, the connector has a working range of compression of between 0.005 inches to 0.025 inches.

Figure 5:
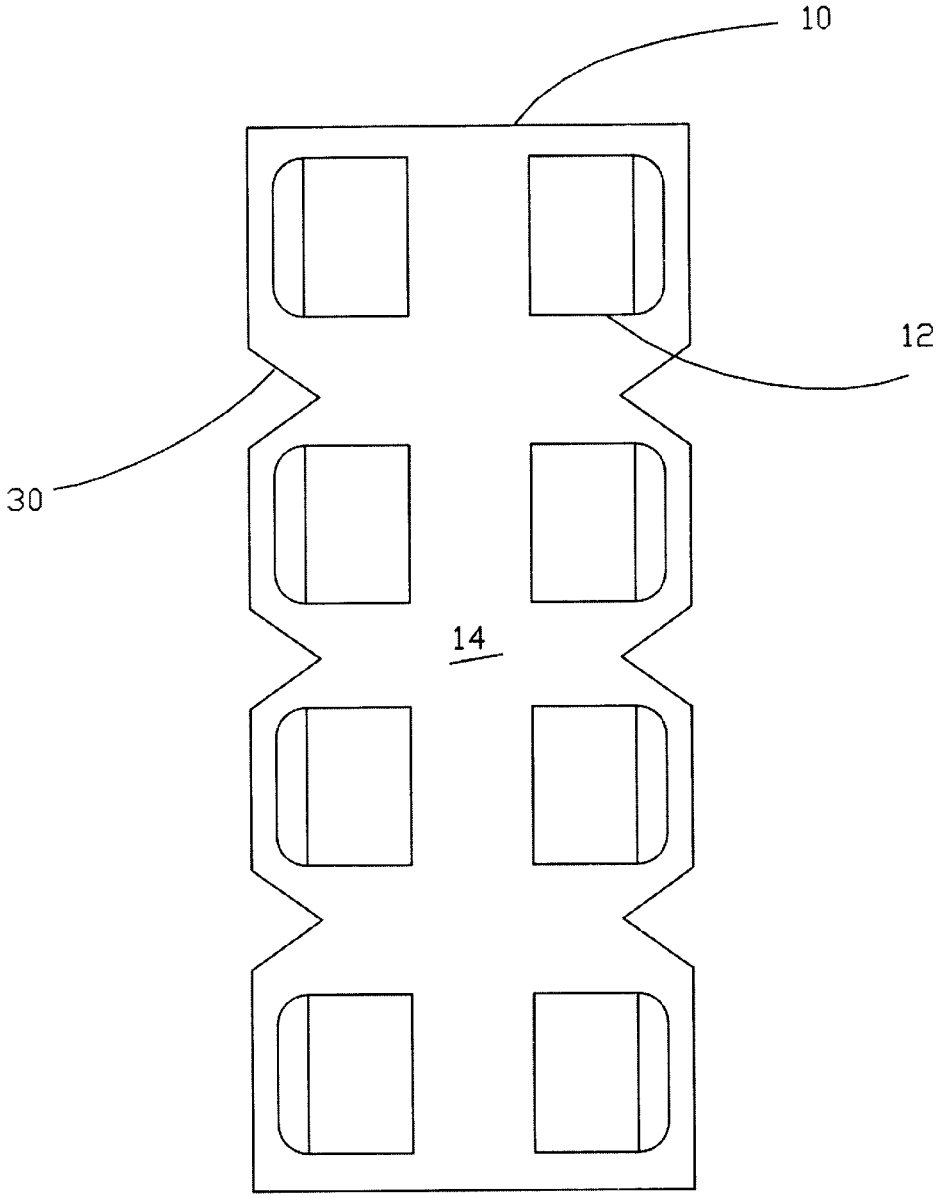
FIG. 5 illustrates a plan view of an embodiment of an elastomeric connector of the present invention.

Referring again to FIG. 1 and as more clearly shown in FIG. 5, grooves 30 are provided on an exterior surface of the body 10 of the connector 1. The grooves 30 in the body 10 may be used for alignment and location of the connector 1 during use. The grooves 30 are formed during the injection molding process of the elastomeric material onto the contacts 12. The shape or depth or geometric features of the grooves 30 may be designed to control the overall resiliency of the body. However, different shapes may be formed during the molding process to meet different requirements as required. Further, the positioning of the elastomer body within a receptacle or frame may be specifically designated in order to control the resiliency of the elastomer body.

Figure 6:
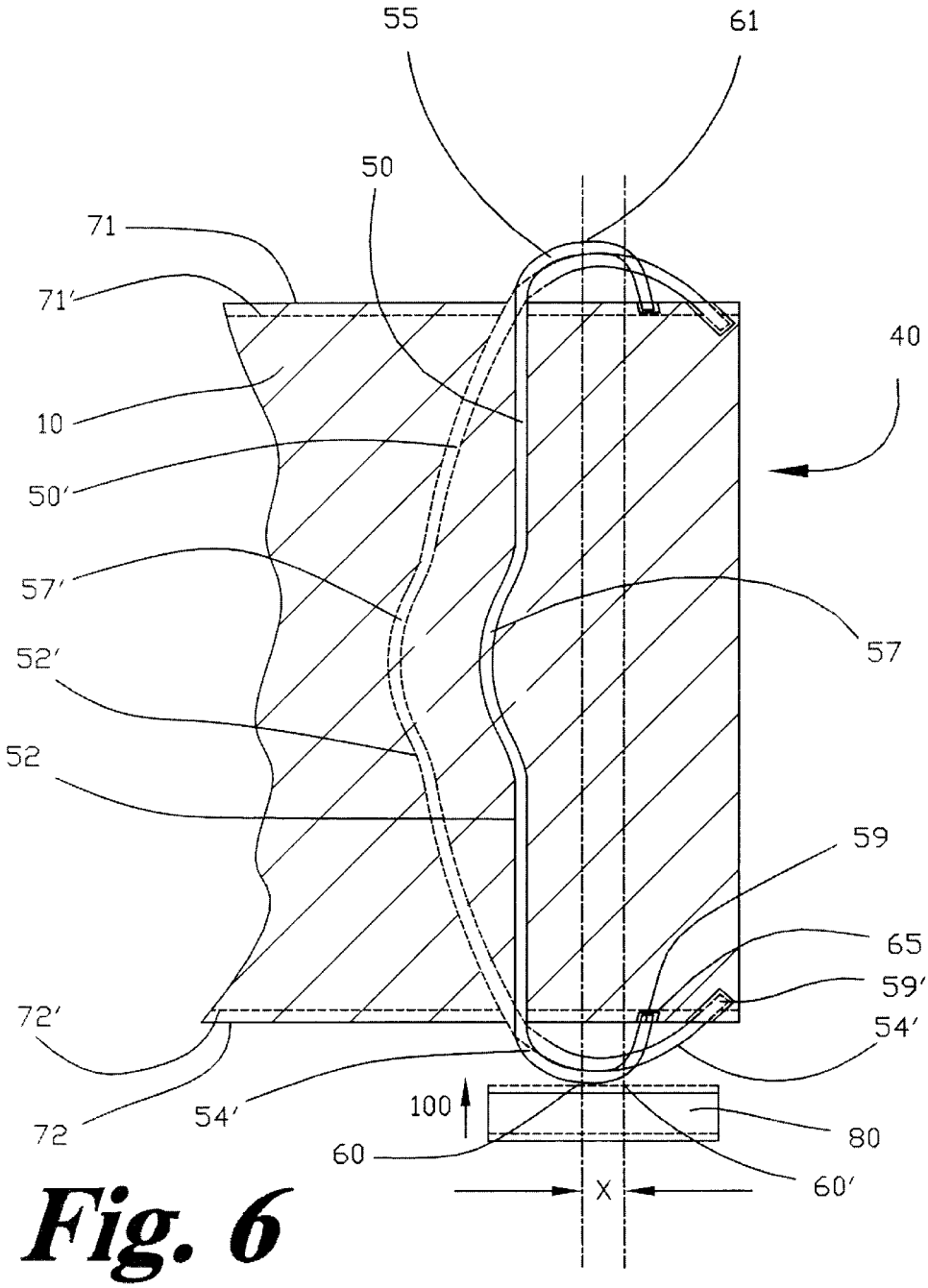
FIG. 6 is an enlarged side elevation, cut-away view of the elastomeric connector of the present invention shown in a compressed and non-compressed state.

Turning to FIG. 6 an alternate embodiment of the present invention is shown having the connector 40 viewed in a side elevation cut-away view showing a non-compressed contact 50 and a compressed contact 50'. The contact 50 includes a central body portion 52 that is embedded within the elastomeric body 10 of the connector 40. Protruding at each end of the body 10 are contact heads 54, 55 which are exposed at the first side 71 and the second side 72, respectively of the body 10 of the connector 40. Each contact head 54, 55 includes an apex point 60, 61. In a preferred embodiment the connector 40 may be inserted into a mating connector of a first electronic element such as a socket of a PCMCIA card for receiving a minicard device so that the contact head 55 at the first side 71 of the connector 40 will make electrical contact with a conductive contact pad (not shown) of the mating connector and the apex point 61 of the contact head 55 will be the first point to abut against and contact the contact pad of the mating connector. The connector 40 will maintain its non-compressed state when the connector 40 is inserted into the mating connector (not shown).

However, when a second electronic element (not shown) is mated at the second side 72 of the body 10 of the connector 40 a conductive contact pad 80 will come into mating contact with the contact head 54 of the contact 50 and the contact pad 80 will first come into contact with the apex point 60 of the contact head 54. As the electrical element to which the contact pad 80 is attached is moved in direction of arrow 100, the contact pad 80 will compress the contact 50 and the body 10. In a preferred embodiment the body 10 has a height of approximately 0.079 inches and the entire connector 40 including the protruding contact heads 54, 55 at each side of 71, 72 has a height of approximately 0.084 inches. Upon mating of the electronic device having contact pad 80 to the connector 40, the connector 40 will be compressed to a height of approximately 0.072 inches. Upon achieving its fully mated position the contact pad is moved only in the axial direction of arrow 100. However, the compression forces of the contact pad 80 against the contact 50 will cause the contact to be compressed and cause the contact head 54 to move into its compressed position as shown by contact head 54'. The pad 80 causes the contact head 54 to move in a likewise axial direction to the pad 80 and in a direction perpendicular to the direction of arrow 100 moving the apex point 60' a distance X from its initial location on the contact pad 80.

In a preferred embodiment the distance that the connector 40 is compressed is approximately equal to 2X (the distance that the apex point 60 will move or wipe on the contact 80). For example, in the preferred embodiment the compression of the connector 40 from 0.084 inches to 0.072 inches, or a total compression or change in the height of the connector 40 is 0.012 inches; then X will approximately equal 0.006 inches. In a preferred embodiment the connector 40 will allow for a wiping motion or stroke in one direction of between 0.001 inches and 0.015 inches. It is noted that upon decompression of the connector the contact head 54, 55 will move back to its initial position providing another wiping motion or stroke. The wiping motion of the contact head 54 on the contact pad 80 provides for a cleaning action of the contact against the contact pad 80 in order to prevent the buildup of harmful materials which may inhibit the electrical connection. The wiping motion also aids in the penetration of the oxidation layer of the contact pad 80.

It should be noted that the description given above has been for a single contact 50,50' of the connector 40. However, it is to be understood that in a preferred embodiment the connector 40 includes a plurality of contacts aligned uniformly along the length of the body 10 of the connector 40 and the wiping motion occurs simultaneously by all of the contacts 50 when an electronic device is mounted to the connector 40. Likewise the wiping action described at the second side 72 of the body which occurs by the contact head 54, also occurs at the first side 71 of the body 10 by the contact head 55 in order to provide a wiping motion of the contact head 55 against a contact pad of the first electronic component. It should also be noted that the central body portion 52 of the contact 50 moves correspondingly according to the compression forces of an electronic element mated to the connector 40.

The contact body 52 includes a dimple 57 or radiused section formed at the center of the central body portion 52 in order to encourage the flexing of the central body portion 52 of the contact 50 upon compression of the connector 40. In a preferred embodiment the dimple portion 52 moves in a direction opposite to that of the wiping motion of the contact head 54, 55 so that it moves into a position 57'. The movement of the central body portion 52 occurs due to the compression forces exerted by the body 10 on the central body portion 52 of the contact 55. The compression of body 10 is illustrated by the movement of the first side 72 moved to a position of 72' and 71 moved to 71'. In a preferred embodiment the distance that the dimple 57' moves is greater than X, or the wiping motion of the contact head 54, 55.

The body 10 of the connector 40 in a preferred embodiment is insert molded around the contact 55. In the embodiment shown in FIG. 6, the body 10 is molded so that a tip 59 of the contact head 54 is imbedded below the first side 72 of the body 10. Therefore, a pocket 65 is formed in the body 10 to receive the tip 59 of the contact head 54. The pocket 65 provides a strain relief for the tip 59 of the contact head 54 and provides stability to the tip so that it will not be able to rotate out of position. Also in the preferred embodiment the contact tip 59' upon compression will penetrate the body 10 more than the contact tip 59 in the non-compressed state. In a preferred embodiment the contact tip 59 may be any portion between the apex point and the open end of the contact.

As was discussed above the contacts 55 and the body 10 combine to provide a predetermined spring force or compression distance dependant on the thickness and volume and composition of the elastomeric body 10 and the shape, weight and composition of the contacts 55. In a preferred embodiment the connector will provide for a spring force of between approximately 15 and 90 grams per contact when deflected between 0 and 20% of the height of the non-compressed connector. Also in a preferred embodiment the contact will provide for a spring force of between 15 and 90 grams per contact when deflected between 0 and 0.016 inches after the connector has been processed through more than 10,000 cycles of compression and decompression. This spring force is sufficient to allow each contact to penetrate an oxidation layer of a conductive pad and provide an optimal electrical connection. In a preferred embodiment the connector provides an average contact resistance of between approximately less to than 150 milliohms over 10,000 cycles. The contacts of the connector in a preferred embodiment have a change in height of less than approximately 5% of its original height over 10,000 cycles. The connector in a preferred embodiment also provides a current capacity of greater than 500 milliamps.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A connector comprising:

a body formed from a flexible material having a pocket formed on a surface of the body and a first side and a second side; and a plurality of formed metal contacts arranged uniformly in the body such that each contact integrally extends from the first side to the second side of the body wherein the contacts provide a spring force and ends of each of the plurality of contacts are exposed at each of the first side and the second side and the contacts provide a wiping stroke of greater than 0.001 inches and a tip of the contact is provided on the end and the contact is formed so that the tip is mounted within the pocket.

2. The connector of claim 1 wherein the body includes a strain relief means to prevent the contacts from rotating.

3. The connector of claim 1 wherein each contact provides a spring force between approximately 15 and 90 grams per contact.

4. The connector of claim 3 wherein the contact has been cycled more than 10,000 times.

5. The connector of claim 4 wherein the connector has received a 0 to 20% reduction in height.

6. The connector of claim 1 further comprising:

a contact head having a semi-circular shape.

7. The connector of claim 1 further comprising:

third and fourth sides perpendicular to the first and second sides of the body wherein the first, second, third, and fourth sides define the body.

8. The connector of claim 1 wherein a contact head is formed at an end of each of the contacts wherein the end is bent at an angle with respect to the sides of the body.

9. The connector of claim 1 wherein the body and the contacts in combination provide a contact having a spring force sufficient to penetrate an oxidation layer of a conductive pad to which the contact is abutting.

10. The connector of claim 1 further comprising:

grooves formed in the sides of the body wherein the grooves extend through the body and provide for resiliency of the connector.

11. The connector of claim 1 wherein the elastomeric material is silicone.

12. A method for connecting two components, the method comprising the steps of:

providing a connector wherein the connector has a body formed from an elastomeric material, the body having a pocket formed on a surface of the body and a first side and a second side;

providing a plurality of formed metal contacts arranged uniformly and extending between the first side and the second side of the body of the connector where the contacts provide a spring force and each of the plurality of contacts has a contact head that is exposed at the first side and the second side of the body and a tip of the contact is provided on the head and the contact is formed so that the tip is mounted within the pocket; and connecting components to the connector thereby providing an electrical connection between the components via the connector having a contact resistance of an average of less than approximately 150 milliohms.

13. The method of claim 12 further comprising the step of:

providing for a wiping motion of the contacts.

14. The method of claim 12 further comprising the step of:

penetrating the oxidation layer of a conductive pad to which the contact is mounted.

15. The method of claim 12 further comprising the step of:

compressing the contact heads of the contact during connection of the components and the average contact compression being less than 5% over 10,000 cycles.

16. The method of claim 12 wherein a wiping stroke of between approximately 0.001 inches and 0.015 inches is provided.

17. The method of claim 12 wherein each contact provides a spring force of between approximately 15 and 90 grams.

18. A method of manufacturing a connector, the method comprising the steps of:

providing a plurality of formed metal contacts;

molding elastomeric material forming a body around a portion of the contacts and molding the body forming a pocket at a first side of the body and wherein the contacts provide a spring force and are substantially equally spaced and parallel to one another; and mounting tips of the contacts within the pockets of the body.

19. The method of claim 17 further comprising the step of:

forming a contact head having a semi-circular shape.

20. The method of claim 18 further comprising the step of:

providing particles on the contact surfaces.

21. The method of claim 17 further comprising the step of:

forming grooves in the exterior walls of the body.

22. The method of claim 17 further comprising the step of:

bending the contact surface of each of the plurality of contacts forming an angle between the contact surfaces and the body.

23. The method of claim 17 wherein the elastomeric material is insert molded around a portion of the contacts.

* * * * *